US006516868B2

(12) United States Patent
Kinosz et al.

(10) Patent No.: US 6,516,868 B2
(45) Date of Patent: Feb. 11, 2003

(54) MOLTEN METAL HOLDER FURNACE AND CASTING SYSTEM INCORPORATING THE MOLTEN METAL HOLDER FURNACE

(75) Inventors: Michael J. Kinosz, Apollo, PA (US); Thomas N. Meyer, Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/769,944

(22) Filed: Jan. 25, 2001

(65) Prior Publication Data

US 2002/0096307 A1 Jul. 25, 2002

(51) Int. Cl.[7] ..... B22D 41/00; C22B 7/00

(52) U.S. Cl. ..... 164/335; 266/242

(58) Field of Search ..... 164/335, 336, 164/337; 222/591, 592, 593; 266/274, 275, 242, 200, 287; 373/109, 117, 122, 127, 137

(56) References Cited

U.S. PATENT DOCUMENTS

| | | | | |
|---|---|---|---|---|
| 3,249,675 A | | 5/1966 | Matchen | 373/130 |
| 3,293,412 A | | 12/1966 | Profitt et al. | 219/421 |
| 3,688,007 A | | 8/1972 | McKenna et al. | 373/110 |
| 3,991,263 A | | 11/1976 | Folgero et al. | 373/140 |
| 4,230,308 A | | 10/1980 | Gueguen | 266/92 |
| 4,263,470 A | | 4/1981 | Sjoberg | 373/125 |
| 4,299,268 A | | 11/1981 | Lavanchy et al. | 164/155.2 |
| 4,590,988 A | | 5/1986 | Fukuoka et al. | 164/463 |
| 4,753,283 A | | 6/1988 | Nakano | 164/312 |
| 4,967,827 A | | 11/1990 | Campbell | 164/134 |
| 5,120,027 A | * | 6/1992 | Pelton | 266/200 |
| 5,398,750 A | | 3/1995 | Crepeau et al. | 164/154.2 |
| 5,411,240 A | | 5/1995 | Rapp et al. | 266/94 |
| 5,459,748 A | * | 10/1995 | Gleichman et al. | 373/132 |
| 5,567,378 A | * | 10/1996 | Mochizuki et al. | 266/44 |
| 5,718,416 A | | 2/1998 | Flisakowski et al. | 266/217 |
| 6,451,248 B1 | * | 9/2002 | Kinosz et al. | 266/242 |

FOREIGN PATENT DOCUMENTS

| | | | |
|---|---|---|---|
| EP | 0510701 | 10/1992 | |
| JP | 6246432 | 6/1994 | |
| WO | WO 97/16051 | * 5/1997 | H05B/3/10 |
| WO | 9737797 | 10/1997 | |

* cited by examiner

*Primary Examiner*—M. Alexandra Elve
*Assistant Examiner*—Kevin P. Kerns
(74) *Attorney, Agent, or Firm*—Webb Ziesenheim Logsdon Orkin & Hanson, P.C.

(57) ABSTRACT

A bottom heated holder furnace (12) for containing a supply of molten metal includes a storage vessel (30) having sidewalls (32) and a bottom wall (34) defining a molten metal receiving chamber (36). A furnace insulating layer (42) lines the molten metal receiving chamber (36). A thermally conductive heat exchanger block (54) is located at the bottom of the molten metal receiving chamber (36) for heating the supply of molten metal. The heat exchanger block (54) includes a bottom face (65), side faces (66), and a top face (67). The heat exchanger block (54) includes a plurality of electrical heaters (70) extending therein and projecting outward from at least one of the faces of the heat exchanger block (54), and further extending through the furnace insulating layer (42) and one of the sidewalls (32) of the storage vessel (30) for connection to a source of electrical power. A sealing layer (50) covers the bottom face (65) and side faces (66) of the heat exchanger block (54) such that the heat exchanger block (54) is substantially separated from contact with the furnace insulating layer (42).

30 Claims, 5 Drawing Sheets

MOLTEN METAL HOLDER FURNACE AND CASTING SYSTEM INCORPORATING THE MOLTEN METAL HOLDER FURNACE

The subject matter of this application was made with United States government support under Contract No. 86X-SU545C awarded by the Department of Energy. The United States government has certain rights to this invention.

BACKGROUND OF THE INVENTION

1. Field of the Invention

The present invention relates to a holder furnace for containing a supply of molten metal and, more particularly, to a bottom heated holder furnace that may be used as part of a molten metal casting system.

2. Description of the Prior Art

Molten metal holding furnaces, or holder furnaces, are used in the art for holding and/or melting molten metal. Holding furnaces are often used to contain a supply of molten metal for injection into a casting machine. For example, U.S. Pat. No. 4,753,283 to Nakano discloses a horizontal injection casting machine in which molten metal is maintained in a holding furnace which periodically provides molten metal to the casting machine. Molten metal from a larger smelting furnace is supplied periodically to the holding furnace to maintain a set amount of molten metal in the holding furnace. The holding furnace is heated by a burner located adjacent a sidewall of the holding furnace.

In addition to the burner arrangement disclosed by the Nakano patent, several other methods are known in the art for heating molten metal contained in a holding furnace. Several common methods include induction heating, radiant heating, and immersion heating. For example, U.S. Pat. No. 4,299,268 to Lavanchy et al. discloses a molten metal casting arrangement in which molten metal is contained in a large capacity pressure ladle (i.e., holding furnace) that is heated by a heating inductor located at the bottom of the pressure ladle. The pressure ladle periodically supplies molten metal to a smaller capacity tilting ladle, which supplies molten metal to a casting apparatus. U.S. Pat. No. 3,991,263 to Folgero et al. discloses a similar molten metal holding system to that disclosed by the Lavanchy et al. patent, but the system disclosed by the Folgero et al. patent is pressurized.

U.S Pat. No. 4,967,827 to Campbell discloses a melting and casting apparatus in which electric radiant heating elements are used to heat molten metal passing from a holding furnace to a casting vessel. U.S. Pat. No. 5,398,750 to Crepeau et al. discloses a molten metal supply vessel in which a plurality of electric immersion heaters is used to heat molten metal in a holding furnace. The immersion heaters extend downward from the holding furnace cover and are partially submerged in the molten metal contained in the holding furnace. U.S. Pat. No. 5,567,378 to Mochizuki et al. discloses a similar immersion heater arrangement to that found in the Crepeau et al. patent.

The above-discussed radiant heating and immersion heating elements for heating molten metal in a holding furnace are located above the surface of the molten metal and are "top" heating arrangements. The "top" heating arrangements known in the art require a significant amount of space above the holding furnace for the individual heating elements. For example, the immersion heaters and electric radiant heaters discussed previously in connection with the Crepeau et al. and Campbell patents require a significant amount of space above the surface of the molten metal in the holding furnace, as well as a support structure above the holding furnace for supporting the heating elements above the surface of the molten metal. External heating arrangements, such as the burner arrangement disclosed by the Nakano patent, heat the holding furnace along a bottom wall or sidewall of the holding furnace and typically require space along the sides or bottom of the holding furnace for the heating elements. With such top/external heating arrangements, it is difficult to maintain a constant molten metal temperature in the holder furnace. In addition, with such top/external heating arrangements it is difficult to maintain a "clean" supply of molten metal. These arrangements are also generally known to contribute to metal oxide formation in the molten metal.

An alternative to top/external heating arrangements is to provide bottom heating devices in holding furnaces. Such bottom heating devices are typically embedded within the bottom wall of the holding furnace. One known bottom heating arrangement in a molten metal holding furnace is disclosed by U.S. Pat. No. 5,411,240 to Rapp et al. The heating cycle of such bottom heating arrangements places significant stress on the bottom wall of the holding furnace. Such embedded arrangements are also generally unsuitable for use with containment difficult metals such as molten aluminum alloys. Any leakage of molten aluminum alloy into the bottom wall of the holding furnace will cause failure of the embedded heating elements.

In view of the foregoing, an object of the present invention is to provide a bottom heated holder furnace for containing molten metal that frees space above the holder furnace. Another object of the present invention is to provide a bottom heated holder furnace that is suitable for use in a molten metal casting system. It is another object of the present invention to provide a bottom heated holder furnace which is suitable for use with molten aluminum alloys, eliminates restriction within the holder furnace, and is less likely to cause metal quality issues.

SUMMARY OF THE INVENTION

The above objects are accomplished with a molten metal holder furnace and molten metal casting system in accordance with the present invention. The holder furnace preferably contains a supply of molten metal that may be supplied to a casting mold through a plurality of molten metal injectors. The holder furnace includes a storage vessel having sidewalls and a bottom wall defining a molten metal receiving chamber for containing the supply of molten metal. At least one furnace insulating layer lines the molten metal receiving chamber of the storage vessel. A thermally conductive heat exchanger block is located at the bottom of the molten metal receiving chamber for heating the supply of molten metal. The heat exchanger block has a top face, a bottom face, and side faces. The heat exchanger block includes a plurality of electrical heaters extending therein and projecting outward from at least one of the faces of the heat exchanger block, and further extending through the furnace insulating layer, and at least one of the sidewalls of the storage vessel for connection to a source of electrical power. A sealing layer at least partially covers the bottom face and side faces of the heat exchanger block such that the heat exchanger block is substantially separated from contact with the furnace insulating layer.

The heat exchanger block may include a plurality of individual heat exchanger blocks connected together along side faces by a tongue-in-groove connection. The storage vessel may further include a molten metal inlet for receiving the supply of molten metal into the molten metal receiving chamber from an external source, and a molten metal outlet for returning the supply of molten metal to the external source. A layer of refractory material may be located within the molten metal receiving chamber and on top of the heat exchanger block. The layer of refractory material may define a plurality of vertically extending chambers. The sealing layer may further partially cover the top face of the heat exchanger block such that the top face of the heat exchanger block is separated from contact with the layer of refractory material except on areas of the top face substantially coincident with the vertically extending chambers whereby the heat exchanger block may be in direct contact with molten metal when a supply of molten metal is contained in the storage vessel and the vertically extending chambers. The plurality of vertically extending chambers may be connected in series from the molten metal inlet to the molten metal outlet of the storage vessel.

A cover may be positioned on top of the storage vessel and substantially enclose the molten metal receiving chamber. The cover may define a plurality of openings corresponding to the plurality of vertically extending chambers for receiving, respectively, the plurality of molten metal injectors into the plurality of vertically extending chambers. A lift device may be located beneath the bottom wall of the storage vessel for lifting the holder furnace into engagement with the plurality of molten metal injectors such that the molten metal injectors extend, respectively, into the plurality of vertically extending chambers defined within the molten metal receiving chamber.

The sealing layer may further line the molten metal receiving chamber. The at least one furnace insulating layer may include a plurality of furnace insulating layers positioned between the sealing layer and the sidewalls and bottom wall of the storage vessel. The sealing layer may be an alumina fiber mat. The heat exchanger block may be made of graphite or silicon carbide.

The electrical heaters may extend between opposite sidewalls of the storage vessel and through the heat exchanger block. The electrical heaters may each include a continuous heating element extending through at least one of the opposite sidewalls, the at least one furnace insulating layer, and extending at least partially through the heat exchanger block. The electrical heaters may each further include respective tubes extending through the opposite sidewalls, the at least one furnace insulating layer, and extending at least partially into opposite faces of the heat exchanger block. The heating element for the electrical heaters may extend at least partially through each of the respective tubes. Sealing gaskets may be positioned within the heat exchanger block. The sealing gaskets may cooperate, respectively, with ends of the tubes extending into the opposite faces of the heat exchanger block for preventing molten metal from leaking into the tubes and contacting the heating element of the electrical heaters. The tubes may be ceramic insulating tubes that are substantially surrounded by a layer of ceramic fiber rope for preventing molten metal from leaking into the ceramic insulating tubes and contacting the heating element of the electrical heaters.

Flange plates may be attached, respectively, to the ceramic insulating tubes at the opposite sidewalls of the storage vessel. The ceramic insulating tubes may be held in compression against the opposite sidewalls of the storage vessel via the flange plates, bolts, and a plurality of Belleville washers stacked to yield about 175 pounds of torque on each of the ceramic insulating tubes. A source of inert gas may be in fluid communication with the heat exchanger block through the tubes such that the heating element of the electrical heaters operates substantially in an inert gas atmosphere during operation of the holder furnace.

Further details and advantages of the present invention will become apparent from the following detailed description in conjunction with the drawings wherein like parts are designated with like reference numerals throughout.

DETAILED DESCRIPTION OF THE PREFERRED EMBODIMENTS

Figure 1:
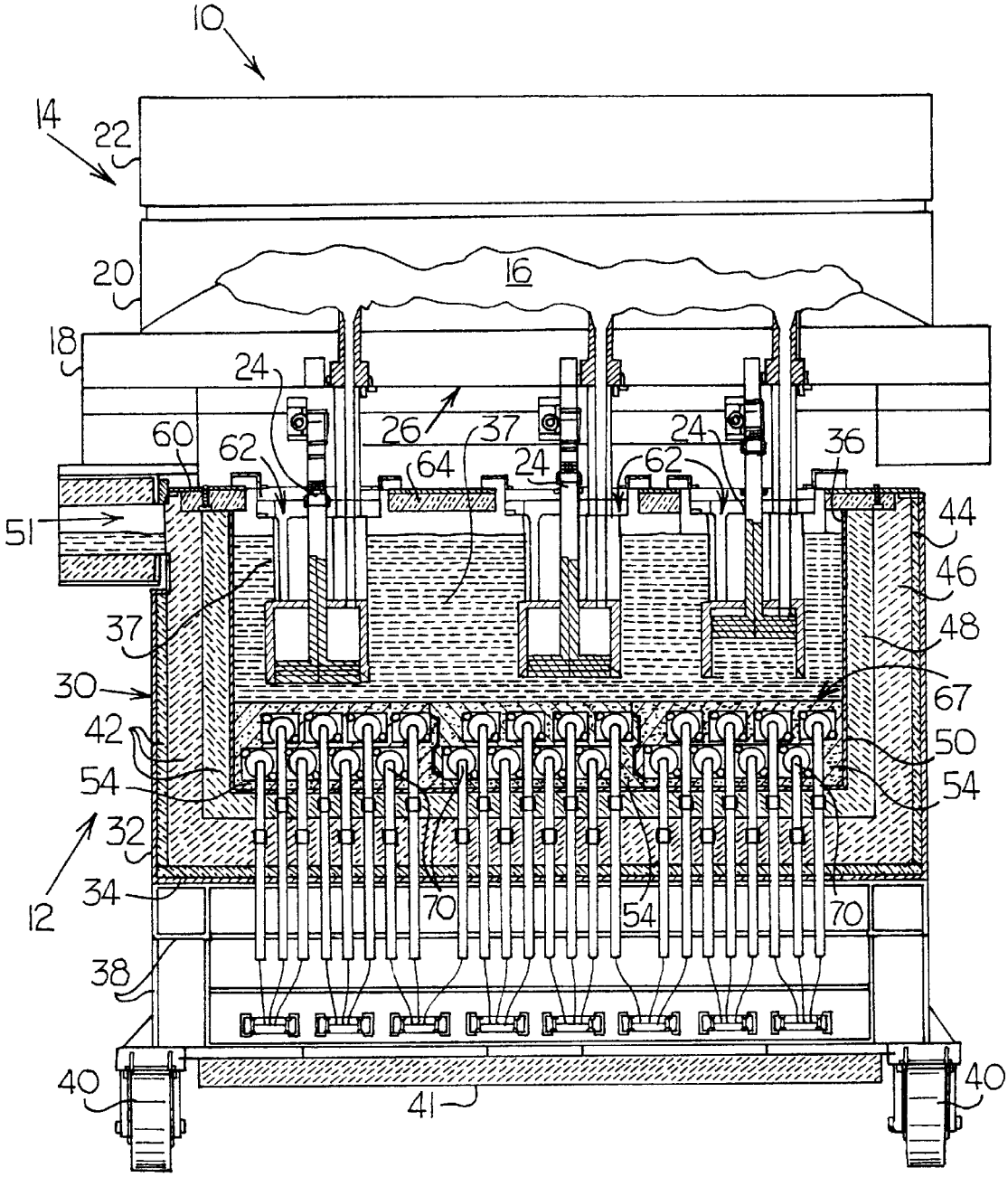
FIG. 1 is a cross-sectional end view of a holder furnace made in accordance with the present invention.
Figure 2:
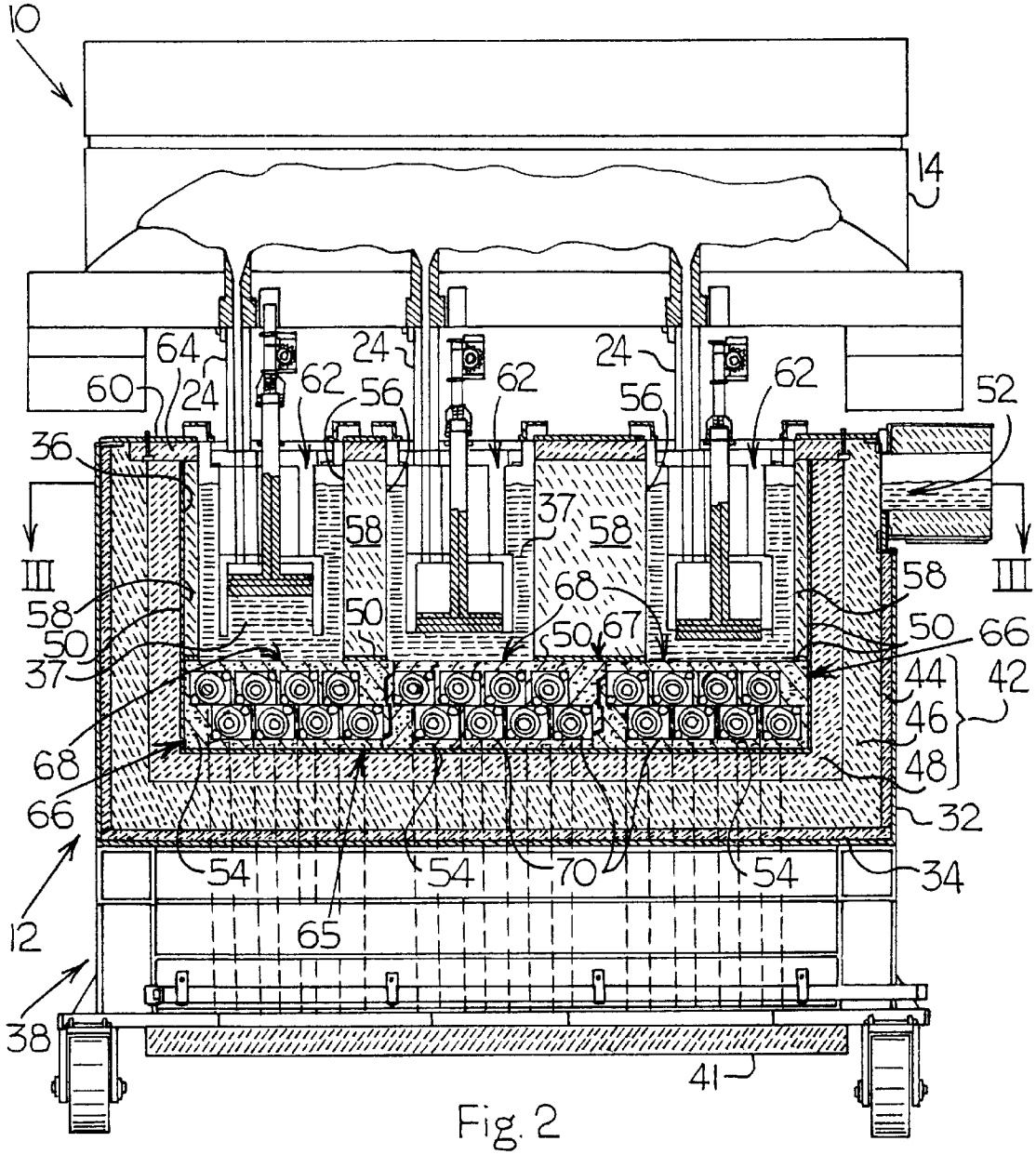
FIG. 2 is a cross-sectional end view of the holder furnace of FIG. 1 viewed from an opposite end of the holder furnace from the cross-sectional view shown in FIG. 1.

FIGS. 1 and 2 show a molten metal casting system 10 incorporating a molten metal holder furnace 12 in accordance with the present invention. The holder furnace 12 is discussed hereinafter in connection with the molten metal casting system 10, but the present invention envisions the use of the holder furnace 12 in applications other than as part of the casting system 10 shown in FIGS. 1 and 2. For example, the holder furnace 12 may be used to supply molten metal to a degassing furnace or a molten metal filtration system. The casting system 10 of the present invention includes a casting mold 14 positioned above the holder furnace 12. The casting mold 14 defines a mold cavity 16 for casting a metal component, such as an automobile part. Preferably, the casting mold 14 is configured to cast ultra-large, thin-walled metal components that may be used in a ground transportation vehicle such as an automobile. An ultra-large, thin-walled metal component part for a ground transportation vehicle may have dimensions approaching 3.0 meters long, 1.7 meters wide, and 0.4 meters in depth, and the mold cavity 16 of the casting mold 14 is preferably configured accordingly. The casting system 10 may also be used to cast metal component parts in the aircraft industry.

The casting mold 14 is preferably suitable for use with molten metal alloys having a low melting point, such as molten aluminum alloys. The casting mold 14 includes a holder frame 18 for supporting the casting mold 14. The casting mold 14 is generally defined by a lower die 20 and an upper die 22, which together define the mold cavity 16. The casting mold 14 through the holder frame 18 is supported by a support surface or structure (not shown), or by other means customary in the art. For example, the casting mold 14 may be supported by a specially designed lower platen that extends downward from the holder frame 18. The lower platen (not shown) is a box-like structure which extends downward from the holder frame 18 and encloses the upper portion of the holder furnace 12. The lower platen may extend downward about four to six feet. The lower platen further preferably defines apertures through which a molten metal and molten metal outlet may extend to place the holder furnace 12 in fluid communication with a melter furnace, as discussed herein. The casting mold 14 may be located about one to two feet above the holder furnace 12 and, more particularly, the lower die 20 may be located about one to two feet above the holder furnace 12 in a preferred embodiment of the present invention.

The molten metal casting system 10 preferably further includes a plurality of molten metal injectors 24 supported from a bottom side 26 of the casting mold 14. The injectors 24 generally provide fluid communication between the mold cavity 16 and the interior of the holder furnace 12. The injectors 24 generally project downward from the bottom side 26 of the casting mold 14 into the holder furnace 12. The injectors 24 may be supported with conventional mechanical fasteners attached to the holder frame 18. Thus, the injectors 24 in a preferred embodiment of the present invention operate against the force of gravity. The injectors 24 are preferably further configured to provide low pressure, hot chamber injection of molten metal contained in the holder furnace 12 into the mold cavity 16. Low pressure, hot chamber injection is particularly well suited for producing components made from non-ferrous metals having a low melting point, such as aluminum, brass, bronze, magnesium, and zinc. The molten metal casting system 10 illustrated in FIGS. 1 and 2 is thus applicable for use in casting ultra-large, thin-walled component parts made of aluminum alloys. However, the casting system 10 and holder furnace 12 of the present invention may also be used to form metal component parts made from metals other than aluminum alloys.

The holder furnace 12 of the present invention will now be discussed in greater detail with reference to FIGS. 1–4. The holder furnace 12 is generally defined by a storage vessel 30 having sidewalls 32 and a bottom wall 34, which enclose a molten metal receiving chamber 36 of the holder furnace 12. The molten metal receiving chamber 36 is configured to contain a supply of molten metal 37. For example, the molten metal receiving chamber 36 may be sized to contain about 2,000 pounds of molten metal 37. The storage vessel 30 may be made of metal and, preferably, steel. The storage vessel 30 includes a base support structure 38 for supporting the holder furnace 12. The support structure 38 includes wheels 40, which make the holder furnace 12 transportable. Accordingly, the holder furnace 12 may be easily replaced in the molten metal casting system 10 shown in FIGS. 1 and 2. In the molten metal casting system 10, a lift device 41 may be located beneath the support structure 38 of the holder furnace 12 for lifting the holder furnace 12 into engagement with the injectors 24 extending downward from the bottom side 26 of the casting mold 14, as discussed further hereinafter. The lift device 41 may be a jack screw device or a hydraulic lift mechanism.

The holder furnace 12 includes a plurality of furnace lining layers 42 lining the molten metal receiving chamber 36. In a preferred embodiment of the holder furnace 12, three furnace lining layers 42 line the molten metal receiving chamber 36. A first layer 44 of the furnace lining layers 42 lies immediately adjacent and in contact with the sidewalls 32 and bottom wall 34 of the storage vessel 30. The first layer 44 is preferably a thermal insulation layer and may have a thickness of about one to three inches. The first layer 44 is preferably a microporous, primarily pressed silica powder (50–90%) material that is encapsulated in a woven fiberglass cloth. A suitable thermal insulating material for the first layer 44 includes Microtherm manufactured by Microtherm Inc., Maryville, Tenn.

A second layer 46 is positioned radially inward from the first layer 44 and is in contact therewith. The second layer 46 is preferably an aluminum-resistant, insulating, and castable material. The second layer 46 may be comprised of primarily silica and alumina, and is preferably light in weight and possesses low thermal conductivity properties. A suitable aluminum-resistant, lightweight, insulating, and castable material for the second layer 46 may include approximately 35% silica and 45% alumina by weight. A suitable aluminum-resistant, lightweight, insulating, and castable material for the second layer 46 includes ALSTOP™ Lightweight Castable manufactured by A. P. Green, Minerva, Ohio.

A third layer 48 of the furnace lining layers 42 lies radially inward from the second layer 46 and is in contact therewith. The third layer 48 is preferably a high alumina content castable layer. For example, the third layer 48 may include about 70–90% alumina by weight. A suitable material for the third layer 48 includes Grefcon™ 80A manufactured by RHI Refractories America and having an alumina content of about 80% by weight. The furnace lining layers 42 generally separate the sidewalls 32 and bottom wall 34 of the storage vessel 30 from the molten metal 37 contained in the molten metal receiving chamber 36.

The surface of the molten metal receiving chamber 36 is preferably formed by a sealing layer 50. The sealing layer 50 is preferably an alumina fiber mat material that lines the molten metal receiving chamber 36. A suitable material for the sealing layer 50 is sold under the trademark SAFIL™ Alumina L D Mat, and manufactured by Thermal Ceramics, Augusta, Ga. The sealing layer 50 may, for example, include about 90–96% alumina fibers by weight.

The holder furnace 12 further includes a molten metal inlet 51 for receiving the molten metal 37 into the molten metal receiving chamber 36 defined by the storage vessel 30, and a molten metal outlet 52 for removing the molten metal 37 from the holder furnace 12. The holder furnace 12 is preferably in fluid communication through the molten metal inlet 51 and the molten metal outlet 52 with a main melter furnace (not shown), which typically contains a large quantity of molten metal that is used to continuously supply the holder furnace 12 with the molten metal 37. The main melter furnace may contain on the order of 30,000 pounds of molten metal.

In operation, molten metal 37 flows from the main melter furnace through the molten metal inlet 51 and into the molten metal receiving chamber 36. The molten metal outlet 52 is used to return the molten metal 37 to the main melter furnace. The molten metal 37 continuously circulates between the main melter furnace and the holder furnace 12. Thus, "clean" molten metal 37 is always present in the holder furnace 12 because of the continuous circulation of the molten metal 37 between the main melter furnace and the holder furnace 12. The molten metal inlet 51 and molten metal outlet 52 of the holder furnace 12 are preferably lined with a refractory material that is suitable for use with molten aluminum alloys. Suitable refractory materials include Permatech™ Sigma or Beta II castable refractory materials manufactured by Permatech Inc., Graham, N.C. Permatech™ Sigma refractory material is comprised of about 64% silica, 30% calcium aluminate cement, and 6% chemical frits by weight, and Permatech™ Beta II refractory material is comprised primarily of about 62% alumina and 29% silica by weight.

Figure 3:
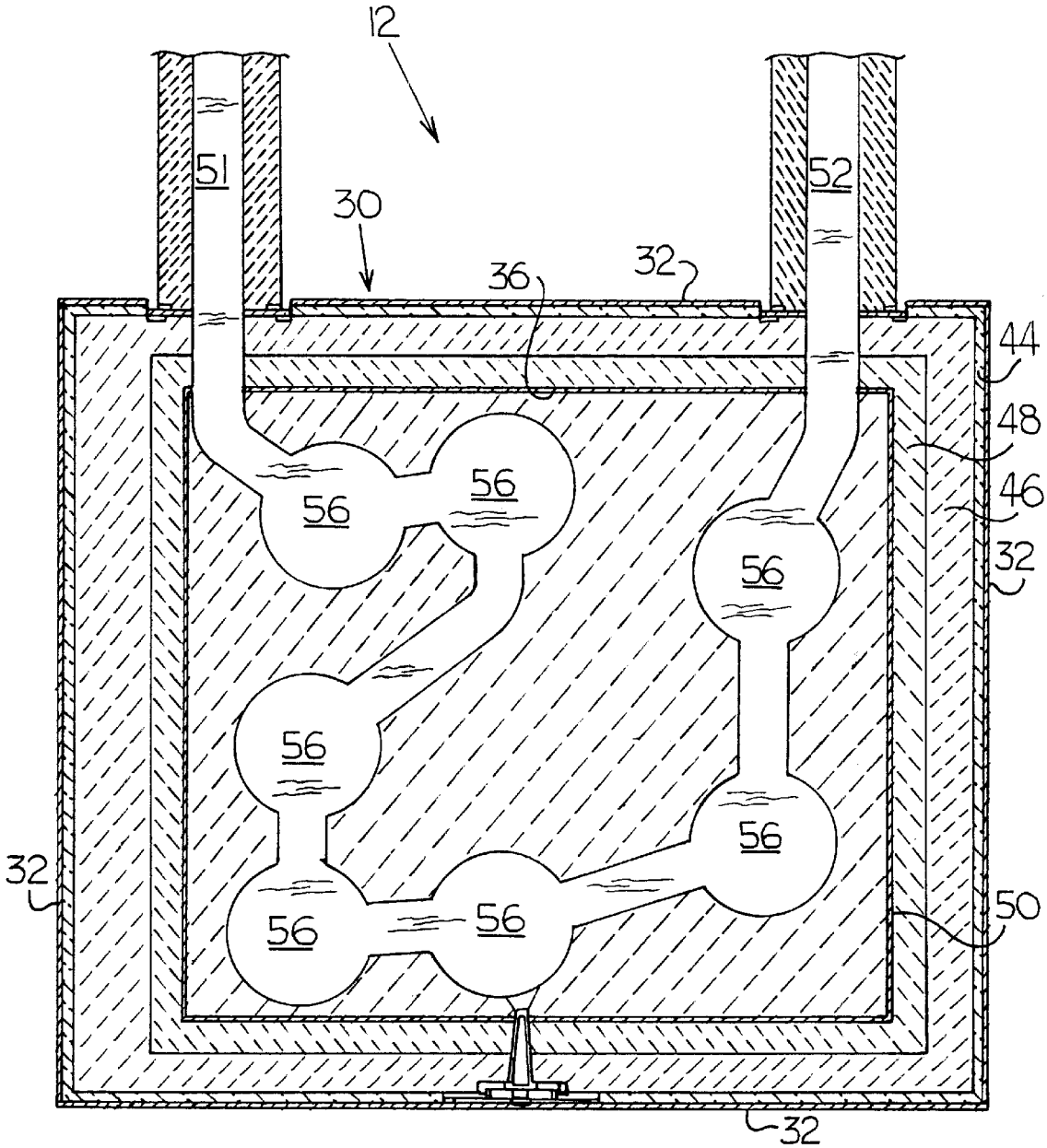
FIG. 3 is a cross-sectional top view of the holder furnace of FIGS. 1 and 2 taken along lines III—III in FIG. 2.
Figure 4:
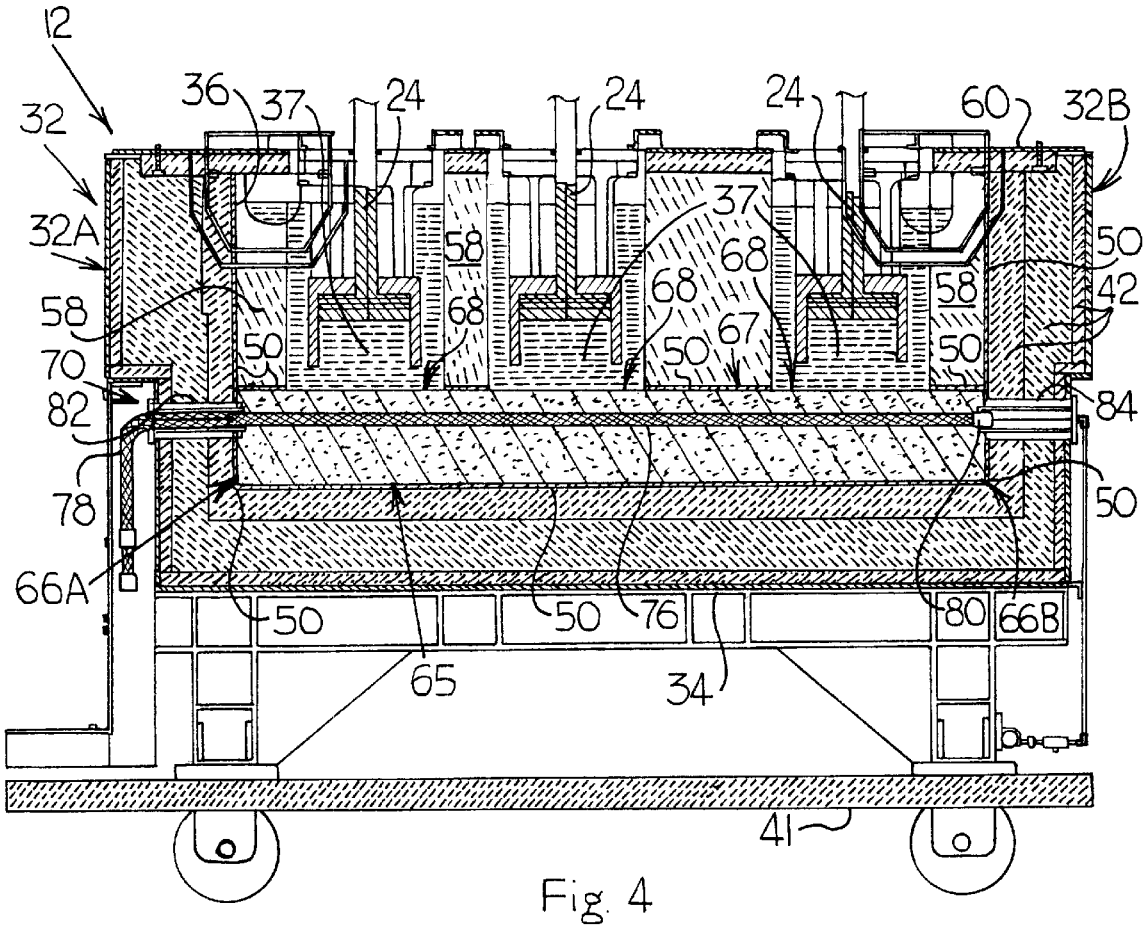
FIG. 4 is a cross-sectional side view of the holder furnace of FIG. 1.

As shown in FIGS. 1 and 2, the holder furnace 12 includes a plurality of heat exchanger blocks 54 located at the bottom of the molten metal receiving chamber 36. The heat exchanger blocks 54 are used to heat the molten metal 37 received in the molten metal receiving chamber 36, as discussed further hereinafter. A plurality of vertically extending injector receiving chambers 56 is optionally formed within the molten metal receiving chamber 36, and on top of the heat exchanger blocks 54, as shown in FIGS. 2–4. The injector receiving chambers 56 are omitted from FIG. 1.

The injector receiving chambers 56 are formed by a layer of refractory material 58 located on top of the heat exchanger blocks 54. The layer of refractory material 58 is preferably suitable for use with molten aluminum alloy, such as Permatech™ Sigma or Beta II castable refractory materials discussed previously, or a substantially equivalent material. The injector receiving chambers 56 are preferably sized to accommodate the injectors 24 supported from the bottom side 26 of the casting mold 14. In particular, when the holder furnace 12 is lifted into engagement with the injectors 24 by the lift device 41, the injectors 24 are received, respectively, into the injector receiving chambers 56. The injectors 24 are omitted in FIG. 3 for clarity. As shown in FIG. 3, the injector receiving chambers 56 may be connected in series from the molten metal inlet 51 to the molten metal outlet 52 of the storage vessel 30. Thus, molten metal from the main melter furnace may flow through the molten metal inlet 51, sequentially into each of the injector receiving chambers 56, and then return to the main melter furnace through the molten metal outlet 52. The lift device 41, as stated previously, is used to lift the holder furnace 12 into and out of engagement with the injectors 24 such that the injectors 24 are received, respectively, into the injector receiving chambers 56.

A furnace cover 60 is positioned on top of the storage vessel 30 to substantially enclose the molten metal receiving chamber 36. The furnace cover 60 preferably includes a plurality of openings 62 corresponding to the plurality of vertically extending injector receiving chambers 56 for receiving, respectively, the injectors 24 into the injector receiving chambers 56. The furnace cover 60 may be made of metal, such as steel, and preferably includes an insulating layer 64 facing the molten metal receiving chamber 36 to protect the furnace cover 60 from contact with the molten metal 37 contained in the molten metal receiving chamber 36. The insulating layer 64 is preferably an insulating blanket material. The insulating blanket material protects the furnace cover 60 from warping because of the high heat of the molten metal 37 in the molten metal receiving chamber 36. Suitable materials for the insulating material include any of the materials discussed previously in connection with the furnace lining layers 42, such as Microtherm, ALSTOP™ Lightweight Castable, and Grefcon™ 80A, or another substantially equivalent material. Another suitable material for the insulating layer 64 includes Maftec™ manufactured by Thermal Ceramics Inc., Augusta, Ga. This material is a heat storage multi-fiber blanket material that is heat resistant to about 2900° F.

As stated previously, the holder furnace 12 includes one or more heat exchanger blocks 54 located at the bottom of the molten metal receiving chamber 36. The heat exchanger blocks 54 are used to heat the molten metal 37 contained in the molten metal receiving chamber 36. Thus, the holder furnace 12 is generally heated from the bottom. The heat exchanger blocks 54 are thermally conductive and are preferably made of graphite, silicon carbide or another material having similar thermally conductive properties. The heat exchanger blocks 54 may be connected together along longitudinal side or end edges by a tongue-in-groove connection as shown, for example, in FIGS. 1 and 2. A preferred tapered angle of the tongue-in-groove connection is about 5°. The heat exchanger blocks 54 may be provided as a single, large heat exchanger block having dimensions conforming to the size of the molten metal receiving chamber 36, or multiple blocks as stated hereinabove. The discussion hereinafter refers to a single heat exchanger block 54 for clarity.

In addition to forming the surface of the molten metal receiving chamber 36, the sealing layer 50, discussed previously, preferably also partially covers or encloses the heat exchanger block 54. In particular, the sealing layer 50 preferably covers the heat exchanger block 54 on a bottom face 65 and side faces 66 of the heat exchanger block 54, and may cover a portion of a top face 67 of the heat exchanger block 54 when the injector receiving chambers 56 are present. The remaining exposed portions of the top face 67 of the heat exchanger block 54 define heat transfer surfaces 68 of the heat exchanger block 54, as shown in FIGS. 2 and 4. The heat transfer surfaces 68 are exposed areas along the top face 67 of the heat exchanger block 54 intended for direct contact with the molten metal 37 contained within the injector receiving chamber 56. The heat transfer surfaces 68 transfer heat from the heat exchanger block 54 to the molten metal 37 contained in the respective injector receiving chamber 56. Thus, the heat transfer surfaces 68 preferably substantially coincide with the injector receiving chambers 56, and the flow passages connecting these chambers (shown in FIG. 3), so that the heat exchanger block 54 may be in direct heat transfer contact with the molten metal 37 received in these chambers.

The sealing layer 50 may be omitted entirely from the top face 67 of the heat transfer block 54 if the injector receiving chambers 56 are not formed in the molten metal receiving chamber 36, as shown in FIG. 1. In this situation, the entire top face 67 of the heat exchanger block 54 is exposed and used to transfer heat to the molten metal 37 received within the molten metal receiving chamber 36. In summary, the sealing layer 50 generally separates the bottom face 65 and side faces 66 of the heat exchanger block 54 from contact with the furnace lining layers 42. Further, the sealing layer 50 may be used to separate portions of the top face 67 of the heat exchanger block 54 from contact with the layer of refractory material 58 forming the injector receiving chambers 56 when these chambers are present in the molten metal receiving chamber 36.

The heat exchanger block 54 further includes a plurality of electrical heaters 70 which are used to heat the heat exchanger block 54 and, further, the molten metal 37 received in the molten metal receiving chamber 36. The embodiment of the holder furnace 12 shown in FIGS. 1 and 2 includes a total of twenty-four electrical heaters 70. Thus, the three heat exchanger blocks 54 shown in FIGS. 1 and 2 each include eight electrical heaters 70. However, it will be appreciated by those skilled in the art that the respective heat exchanger blocks 54 may include any number of electrical heaters 70. The electrical heaters 70 may, for example, be resistive type electrical heating heaters that extend completely or partially through the respective heat exchanger blocks 54. For aluminum alloy applications, the electrical heaters 70 are preferably sized to maintain a system molten metal temperature of between about 1300–1500° F., and preferably about 1400° F.

Figure 6:
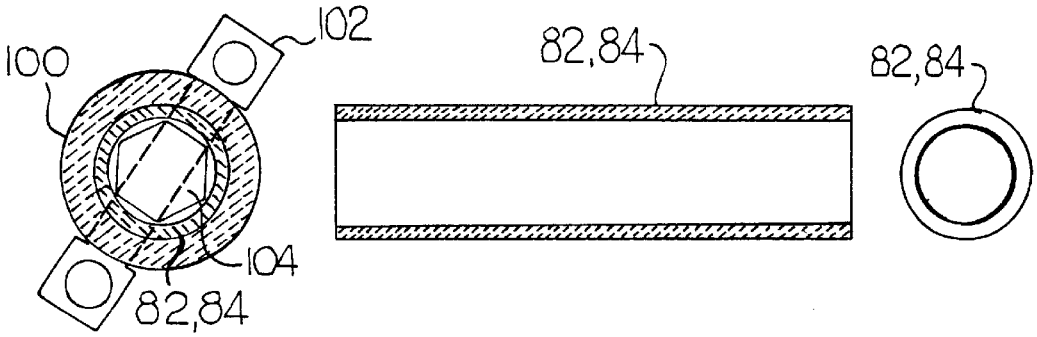
FIG. 6 is a front view, cross-sectional side view, and end view, respectively, of a ceramic insulating tube used in the heat exchanger block of FIG. 5.
Figure 5:
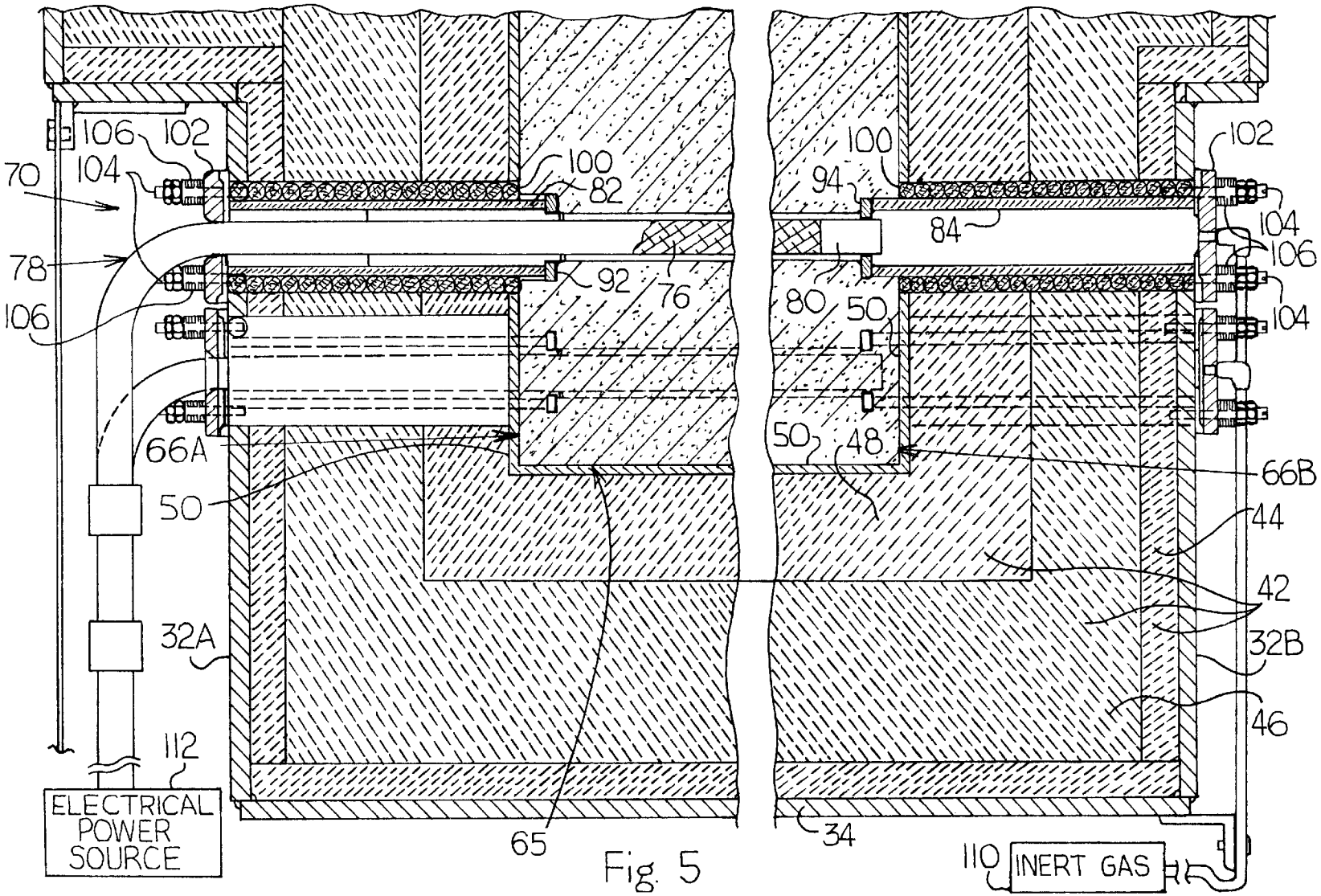
FIG. 5 is a partial cross-sectional end view of the holder furnace of FIG. 1 showing further details of a heat exchanger block used in the holder furnace.

The details of the heat exchanger block 54 and plurality of electrical heaters 70 shown in FIGS. 1 and 2 will now be discussed in detail with reference to FIGS. 4–6. It will be apparent that the electrical heaters 70 in each of the three heat exchanger blocks 54 shown in FIGS. 1 and 2 are identical, and a discussion of the details of one of the electrical heaters 70 will be illustrative of all of the electrical heaters 70 shown in FIGS. 1 and 2.

The electrical heater 70, in a preferred embodiment, extends between opposite sidewalls of the storage vessel 30. The opposite sidewalls of the storage vessel 30 are designated with reference numerals 32A, 32B, respectively, and will be referred to hereinafter as first sidewall 32A and second sidewall 32B for clarity. The electrical heater 70 preferably extends through the first sidewall 32A, the furnace insulating layers 42, the heat exchanger block 54, and the second sidewall 32B of the storage vessel 30. In FIGS. 4 and 5, the electrical heater 70 extends substantially parallel to a longitudinal axis of the holder furnace 12. However, the present invention envisions that the electrical heater 70 may be oriented transverse to the longitudinal axis of the holder furnace 12, or at any other orientation as long as the electrical heater 70 extends substantially through the heat exchanger block 54.

The electrical heater 70 includes a continuous heating element 76 that extends through the first sidewall 32A, the furnace insulating layers 42, and extends substantially through the heat exchanger block 54. A portion 78 of the continuous heating element 76 projects outward from one of the side faces 66 of the heat exchanger block 54. The opposite side faces of the heat exchanger block 54 are designated with reference numerals 66A, 66B, respectively, and will be referred to hereinafter as first side face 66A and second side face 66B for clarity. The continuous heating element 76 is preferably a resistive type electrical heating element.

The heating element 76 includes an end 80, or "cold toe", which terminates within the heat exchanger block 54. The portion 78 of the heating element 76 that projects outward from the first side face 66A of the heat exchanger block 54 is preferably enclosed by a first insulating tube 82. The first insulating tube 82 extends through the first sidewall 32A, the furnace lining layers 42, and extends partially into the first side face 66A of the heat exchanger block 54. A second insulating tube 84 preferably extends through the second sidewall 32B, the furnace insulating layers 42, and extends partially into the second side face 66B of the heat exchanger block 54. A first sealing gasket 92 is located within the heat exchanger block 54 adjacent the end of the first insulating tube 82 extending into the heat exchanger block 54 at the first side face 66A. The first sealing gasket 92 cooperates with the end of the first insulating tube 82 for preventing molten metal 37 from contacting the continuous heating element 76. A second sealing gasket 94 is located within the heat exchanger block 54 adjacent the end of the second insulating tube 84 extending into the heat exchanger block 54 at the second side face 66B. The second sealing gasket 94 cooperates with the end of the second insulating tube 84 extending into the heat exchanger block 54 at the second side face 66B for preventing molten metal 37 from contacting the continuous heating element 76.

The first and second insulating tubes 82, 84 are preferably ceramic insulating tubes. The first and second sealing gaskets 92, 94 are preferably made of an alumina fiber mat material having a high alumina fiber content similar to the material used for the sealing layer 50. A suitable material for the first and second sealing gaskets 92, 94 is sold under the trademark SAFIL™ Alumina L D Mat and manufactured by Thermal Ceramics, Augusta, Ga., as discussed previously in connection with the sealing layer 50.

The first and second insulating tubes 82, 84 are preferably each surrounded by a layer of ceramic fiber rope 100 for preventing molten metal 37 from leaking into the first and second insulating tubes 82, 84 and contacting the continuous heating element 76. A suitable ceramic fiber rope material includes Fiberfrax high density rope manufactured by the Carborundum Company, Niagara Falls, N.Y. Fiberfrax is comprised primarily of alumina-silica. Flange plates 102 are attached, respectively, to the first and second insulating tubes 82, 84 at the first and second sidewalls 32A, 32B of the storage vessel 30. The first and second insulating tubes 82, 84 are preferably held in compression against the first and second sidewalls 32A, 32B of the storage vessel 30 by the flange plates 102, bolts 104, and a plurality of washers 106. The washers 106 are preferably Belleville spring washers, which are stacked on the bolts 104 to yield about 175 pounds of torque on the first and second insulating tubes 82, 84. The first and second insulating tubes 82, 84 are held in compression against the first and second sidewalls, or opposite sidewalls, 32A, 32B of the storage vessel 30 to counteract the thermal expansion of the heat exchanger block 54 under heating conditions.

The holder furnace 12 of the present invention may further include a source of inert gas 110 in fluid communication with the heat exchanger block 54 through the first and second insulating tubes 82, 84. The source of inert gas 110 provides inert gas, such as argon or nitrogen, to the interior of the heat exchanger block 54 such that the continuous heating element 76 of the electrical heater 70 operates in a substantially inert gas atmosphere. This prevents the heat exchanger block 54, which is may be made primarily of carbon, from burning during operation of the holder furnace 12. The electrical heater 70 and, more particularly, the continuous heating element 76 are connected to a source of electrical power 112, which provides electrical power to the continuous heating element 76. As stated previously, the construction of the electrical heater 70 discussed hereinabove is identical for each of the electrical heaters 70 used in the heat exchanger block 54. A preferred embodiment of the holder furnace 12 includes three heat exchanger blocks 54, each having a set of eight electrical heaters 70.

In operation, when electrical power is supplied to the electrical heater 70 and, in particular, the continuous heating element 76, the heat exchanger block 54 is heated. The exposed heat transfer surfaces 68 along the top face 67 of the heat exchanger block 54, which are in contact with the molten metal 37 in the respective injector receiving chambers 56, heat the molten metal 37 received in the injector receiving chambers 56. The lift device 41 may be used to place the holder furnace 12 into and out of engagement with the injectors 24 supported from the bottom side 26 of the casting mold 14. The lift device 41 may be a hydraulic lift table or a screw jack lifting device. The injectors 24 are configured to take in the molten metal 37 received in the injector receiving chambers 56 and inject the molten metal 37 under low pressure into the mold cavity 16 of the casting mold 14.

FIG. 3 shows seven injector receiving chambers 56 for casting, for example, a liftgate of a minivan. The arrangement of the injector receiving chambers 56 in FIG. 3 is specific to the liftgate of a minivan. As will be appreciated by those skilled in the art, the injector receiving chambers 56 may be formed in any manner in the molten metal receiving chamber 36 of the holder furnace 12 to form metal parts other than the liftgate of a minivan, or omitted altogether. The liftgate of a minivan is cited simply as an example. The holder furnace 12 is preferably positioned beneath the casting mold 14 and the injectors 24 received within the injector receiving chambers 56 prior to circulating molten metal from the melter furnace to the holder furnace 12. As stated previously, the lift device 41 may be used to lift the holder furnace 12 into engagement with the injectors 24. A programmable logic controller (not shown) preferably individually controls the injectors 24 such that the injectors 24 may be sequenced at different times and at different rates to fill the mold cavity 16 of the casting mold 14 completely with molten aluminum alloy, and to prevent the formation of air pockets within the mold cavity 14 and, ultimately, the cast part. For example, it may be advantageous to sequence the injection of molten aluminum alloy into the mold cavity 14 so that areas of the mold cavity 14 having greater volume are filled at a faster rate than those areas of the mold cavity 14 that are of smaller volume. The injectors 24 may be sequenced accordingly. The injectors 24, as evidenced by the arrangement shown in FIGS. 1, 2, and 4, generally operate against the force of gravity, and are preferably selected for use with containment difficult metals such as aluminum alloys.

The present invention provides a bottom heated holder furnace for containing molten metal that frees space above the holder furnace for a casting mold. The holder furnace of the present invention is suitable for use with the previously described casting mold or another apparatus such as an aluminum degassing furnace or a molten metal filtration system. The present invention further provides a bottom heated holder furnace that is particularly well suited for use with molten aluminum alloys because the electrical heaters used to heat the holder furnace are isolated from contact with the molten aluminum. Furthermore, the holder furnace of the present invention may be used as part of a molten metal casting system for producing ultra-large, thin-walled component parts such as those that may be used in the automobile and aircraft industries.

While preferred embodiments of the present invention were described herein, various modifications and alterations of the present invention may be made without departing from the spirit and scope of the present invention. The scope of the present invention is defined in the appended claims and equivalents thereto.

We claim:

1. A holder furnace, comprising:

a storage vessel having sidewalls and a bottom wall defining a molten metal receiving chamber for containing a supply of molten metal;

at least one furnace insulating layer lining the molten metal receiving chamber of the storage vessel;

a thermally conductive heat exchanger block located at the bottom of the molten metal receiving chamber for heating the supply of molten metal, with the heat exchanger block having a top face, a bottom face, and side faces, and with the heat exchanger block having a plurality of electrical heaters each including a continuous electrically resistive heating element extending therein and projecting outward from at least one of the faces of the heat exchanger block and further extending through the furnace insulating layer and at least one of the sidewalls of the storage vessel for connection to a source of electrical power; and a sealing layer covering the bottom face and side faces of the heat exchanger block and completely lining the molten metal receiving chamber such that the heat exchanger block is substantially separated from contact with the furnace insulating layer, and such that the molten metal from the supply of molten metal is prevented from contacting the electrical heaters, wherein the heating element of each of the electrical heaters, in operation, generates heat energy that is transferred to the heat exchanger block for heating the molten metal in the molten metal receiving chamber.

2. The holder furnace of claim 1, wherein the heat exchanger block includes a plurality of individual heat exchanger blocks connected together along side faces by a tongue-in-groove connection.

3. The holder furnace of claim 1, wherein the storage vessel further includes a molten metal inlet for receiving the supply of molten metal into the molten metal receiving chamber from an external source, and a molten metal outlet for returning the supply of molten metal to the external source.

4. The holder furnace of claim 3, further comprising a layer of refractory material located within the molten metal receiving chamber and on top of the heat exchanger block, with the layer of refractory material defining a plurality of vertically extending chambers, and wherein the sealing layer further partially covers the top face of the heat exchanger block such that the top face of the heat exchanger block is separated from contact with the layer of refractory material except on areas of the top face substantially coincident with the vertically extending chambers.

5. The holder furnace of claim 4, wherein the plurality of vertically extending chambers is connected in series from the molten metal inlet to the molten metal outlet of the storage vessel.

6. The holder furnace of claim 4, further comprising a cover positioned on top of the storage vessel and substantially enclosing the molten metal receiving chamber, and wherein the cover defines a plurality of openings corresponding to the plurality of vertically extending chambers for receiving, respectively, a plurality of molten metal injectors into the plurality of vertically extending chambers.

7. The holder furnace of claim 1, wherein the sealing layer further lines the molten metal receiving chamber, and wherein the at least one furnace insulating layer includes a plurality of furnace insulating layers positioned between the sealing layer and the sidewalls and bottom wall of the storage vessel.

8. The holder furnace of claim 1, wherein the sealing layer comprises an alumina fiber mat.

9. The holder furnace of claim 1, wherein the heat exchanger block is made of one of graphite and silicon carbide.

10. The holder furnace of claim 1, wherein the electrical heaters extend between opposite sidewalls of the storage vessel and through the heat exchanger block, wherein the continuous heating element of each of the electrical heaters extends through at least one of the opposite sidewalls, the at least one furnace insulating layer, and extends at least partially through the heat exchanger block, and wherein the electrical heaters each further include respective tubes extending through the opposite sidewalls, the at least one furnace insulating layer, and extending at least partially into opposite faces of the heat exchanger block, with the heating element of each of the electrical heaters extending at least partially through the tubes, respectively.

11. The holder furnace of claim 10, further including sealing gaskets positioned within the heat exchanger block, and wherein the sealing gaskets cooperate, respectively, with ends of the tubes extending into the opposite faces of the heat exchanger block for preventing molten metal from leaking into the tubes and contacting the heating element of the electrical heaters.

12. The holder furnace of claim 11, wherein the tubes are ceramic insulating tubes and are each surrounded by a layer of ceramic fiber rope for preventing molten metal from the supply of molten metal from leaking into the ceramic insulating tubes and contacting the heating element of the electrical heaters.

13. The holder furnace of claim 12, further including flange plates attached, respectively, to the ceramic insulating tubes at the opposite sidewalls of the storage vessel, and wherein the ceramic insulating tubes are held in compression against the opposite sidewalls of the storage vessel by the flange plates and mechanical fasteners.

14. The holder furnace of claim 10, further comprising a source of inert gas in fluid communication with the heat exchanger block through the tubes such that the heating element of the electrical heaters operates substantially in an inert gas atmosphere during operation of the holder furnace.

15. A heat exchanger block for use in combination with a holder furnace comprising a storage vessel defining a molten metal receiving chamber lined with at least one furnace insulating layer and a sealing layer completely lining the molten metal receiving chamber, the heat exchanger block comprising:

a thermally conductive block having a top face, bottom face, and side faces;

a plurality of continuous electrically resistive heating elements extending into the thermally conductive block and including a portion projecting outward from one of the side faces of the thermally conductive block;

a first plurality of tubes positioned, respectively, about the portion of the heating elements projecting outward from the thermally conductive block, with the first plurality of tubes extending at least partially into the thermally conductive block; and a first plurality of sealing gaskets located within the thermally conductive block and positioned, respectively, adjacent ends of the first plurality of tubes extending into the thermally conductive block, with the sealing gaskets cooperating with the ends of the first plurality of tubes for preventing molten metal from contacting the heating elements when the heat exchanger block is used in the holder furnace, wherein the heating elements, in operation, generate heat energy that is transferred to the thermally conductive block for heating the molten metal in the holder furnace, and wherein with the heat exchanger block positioned in the molten metal receiving chamber, the sealing layer covers the bottom face and side faces of the thermally conductive block such that the thermally conductive block is substantially separated from contact with the at least one furnace insulating layer, and such that molten metal received in the molten metal receiving chamber is prevented from contacting the heating elements.

16. The heat exchanger block of claim 15, wherein the heating elements extend through the thermally conductive block substantially to an opposite side face of the thermally conductive block, with the heating elements each having an end terminating within the thermally conductive block, and with the heat exchanger block further including:

a second plurality of tubes extending at least partially into the opposite side face of the thermally conductive block and cooperating, respectively, with the ends of the heating elements located within the thermally conductive block; and a second plurality of sealing gaskets located within the thermally conductive block and positioned, respectively, adjacent ends of the second plurality of tubes extending into the thermally conductive block at the opposite side face, with the sealing gaskets cooperating with the ends of the second plurality of tubes extending into the thermally conductive block at the opposite side face for preventing molten metal from contacting the heating elements when the heat exchanger block is used in the holder furnace.

17. The heat exchanger block of claim 16, wherein the first and second plurality of tubes are ceramic insulating tubes, and wherein exposed portions of the first and second plurality of ceramic insulating tubes extending outward from the side faces of the thermally conductive block are surrounded by a layer of ceramic fiber rope for preventing molten metal from the holder furnace from leaking into the first and second plurality of ceramic insulating tubes and contacting the heating elements when the heat exchanger block is used in the holder furnace.

18. The heat exchanger block of claim 15, further including a sealing layer covering the bottom face and side faces of the thermally conductive block, with the sealing layer comprising an alumina fiber mat.

19. The heat exchanger block of claim 15, wherein the thermally conductive block is made of one of graphite and silicon carbide.

20. A molten metal casting system, comprising:

a casting mold defining a mold cavity for casting a metal component;

a plurality of molten metal injectors supported from a bottom side of the casting mold and in fluid communication with the mold cavity;

a holder furnace located below the casting mold and molten metal injectors for containing a supply of molten metal for injection into the mold cavity through the molten metal injectors, with the holder furnace further comprising:

a storage vessel having sidewalls and a bottom wall defining a molten metal receiving chamber for containing the supply of molten metal;

at least one furnace insulating layer lining the molten metal receiving chamber of the storage vessel;

a thermally conductive heat exchanger block located at the bottom of the molten metal receiving chamber for heating the supply of molten metal, with the heat exchanger block having a top face, a bottom face, and side faces, and with the heat exchanger block having a plurality of electrical heaters each including a continuous electrically resistive heating element extending therein and projecting outward from at least one of the faces of the heat exchanger block and further extending through the furnace insulating layer and at least one of the sidewalls of the storage vessel for connection to a source of electrical power; and a sealing layer covering the bottom face and side faces of the heat exchanger block and completely lining the molten metal receiving chamber such that the heat exchanger block is substantially separated from contact with the furnace insulating layer, and such that the molten metal from the supply of molten metal is prevented from contacting the electrical heaters; and a lift device located beneath the bottom wall of the storage vessel for lifting the holder furnace into engagement with the plurality of molten metal injectors such that the molten metal injectors extend into the molten metal receiving chamber, wherein the heating element of each of the electrical heaters, in operation, generates heat energy that is transferred to the heat exchanger block for heating the molten metal in the molten metal receiving chamber.

21. The molten metal casting system of claim 20, wherein the storage vessel further includes a molten metal inlet for receiving the supply of molten metal into the molten metal receiving chamber from an external source, and a molten metal outlet for returning the supply of molten metal to the external source.

22. The molten metal casting system of claim 21, further comprising a layer of refractory material located within the molten metal receiving chamber and on top of the heat exchanger block, with the layer of refractory material defining a plurality of vertically extending chambers, and wherein the sealing layer further partially covers the top face of the heat exchanger block such that the top face of the heat exchanger block is separated from contact with the layer of refractory material except on areas of the top face substantially coincident with the vertically extending chambers.

23. The molten metal casting system of claim 22, wherein the plurality of vertically extending chambers is connected in series from the molten metal inlet to the molten metal outlet of the storage vessel.

24. The molten metal casting system of claim 22, further comprising a cover positioned on top of the storage vessel and substantially enclosing the molten metal receiving chamber, and wherein the cover defines a plurality of openings corresponding to the plurality of vertically extending chambers for receiving, respectively, a plurality of molten metal injectors into the plurality of vertically extending chambers.

25. The molten metal casting system of claim 20, wherein the sealing layer comprises an alumina fiber mat.

26. The molten metal casting system of claim 20, wherein the electrical heaters extend between opposite sidewalls of the storage vessel and through the heat exchanger block, wherein the continuous heating element of each of the electrical heaters extends through at least one of the opposite sidewalls, the at least one furnace insulating layer, and extends at least partially through the heat exchanger block, and wherein the electrical heaters each further include respective tubes extending through the opposite sidewalls, the at least one furnace insulating layer, and extending at least partially into opposite faces of the heat exchanger block, with the heating element of each of the electrical heaters extending at least partially through the tubes, respectively.

27. The molten metal casting system of claim 26, further including sealing gaskets positioned within the heat exchanger block, and wherein the sealing gaskets cooperate, respectively, with ends of the tubes extending into the opposite faces of the heat exchanger block for preventing molten metal from leaking into the tubes and contacting the heating element of the electrical heaters.

28. The molten metal casting system of claim 27, wherein the tubes are ceramic insulating tubes and are each surrounded by a layer of ceramic fiber rope for preventing molten metal from the supply of molten metal from leaking into the ceramic insulating tubes and contacting the heating element of the electrical heaters.

29. The molten metal casting system of claim 28, further including flange plates attached, respectively, to the ceramic insulating tubes at the opposite sidewalls of the storage vessel, and wherein the ceramic insulating tubes are held in compression against the opposite sidewalls of the storage vessel by the flange plates and mechanical fasteners.

30. The molten metal casting system of claim 26, further comprising a source of inert gas in fluid communication with the heat exchanger block through the tubes such that the heating element of the electrical heaters operates substantially in an inert gas atmosphere during operation of the holder furnace.

* * * * *